US005467478A

United States Patent [19]

Slaughter et al.

[11] Patent Number: 5,467,478

[45] Date of Patent: Nov. 21, 1995

[54] HANDKERCHIEF WITH FINGER SECURING LOOP

[76] Inventors: John L. Slaughter; Ella M. Slaughter, both of 2607 W. Burnell, Muncie, Ind. 47304

[21] Appl. No.: 364,807

[22] Filed: Dec. 27, 1994

[51] Int. Cl.[6] ..... A41B 15/00

[52] U.S. Cl. ..... 2/1; 2/279; 2/207; D2/500; D2/502; 63/15

[58] Field of Search ..... 2/163, 279, 1, 2/21, 207, 144; D2/500, 502; 63/15, 3, 2; 428/4, 5; 112/413, 426, 428, 439; D6/623, 624

[56] References Cited

U.S. PATENT DOCUMENTS 308,626 12/1884 Pike ..... 63/2 X 1,772,228 8/1929 Rochester .

4,177,846 12/1979 Rountree ..... 428/4 X 4,224,712 9/1980 Black et al. .

*Primary Examiner*—C. D. Crowder

*Assistant Examiner*—Shirra L. Jenkins

*Attorney, Agent, or Firm*—Locke Reynolds

[57] ABSTRACT

A handkerchief having a flexible, elastic loop surrounded by a fabric sheath attached to the center of the handkerchief. By placing a finger through the loop, the handkerchief is removably disposed proximate to the fingers without necessitating continuous grasping of the handkerchief by the user.

19 Claims, 3 Drawing Sheets

HANDKERCHIEF WITH FINGER SECURING LOOP

BACKGROUND OF THE INVENTION

1. Field of the Invention

The present invention generally relates to handkerchiefs, and more particularly concerns handkerchiefs that may be disposed proximate to the hand without necessitating the user to continuously grasp or hold the handkerchief.

2. Description of the Prior Art

Before and after use, common handkerchiefs require the user to store the handkerchief in the user's clothing, purse, or other location, or must be continuously held by the user. Handkerchiefs that may be disposed at or near the hand of the user without requiring the user to hold the handkerchief include articles that are removably attachable in a looping manner around the wrist of the user, such as that described by U.S. Pat. No. 1,772,228.

Despite the availability of such handkerchiefs, there exists a need in the art for a handkerchief that is capable of being removably disposed in close proximity to the fingers of the user for easy and convenient use without necessitating the user to continuously grasp or hold the handkerchief, yet may be used by individuals having hands of various sizes.

SUMMARY OF THE INVENTION

In order to aid in the understanding of the present invention, it can be stated in essentially summary form that it is directed to a handkerchief that is capable of being removably disposed proximate to the fingers without necessitating continuous grasping of the handkerchief by the user, yet may be used by individuals having hands and fingers of various sizes.

It is an object of the present invention to provide a handkerchief that is capable of being removably disposed proximate to the fingers.

It is another object of the present invention to provide a handkerchief that is capable of use without necessitating continuous grasping or holding of the handkerchief by the user.

It is another object of the present invention to provide a handkerchief that is capable of use by individuals having fingers of various sizes.

It is another object of the present invention to provide a handkerchief that is sturdy, comfortable to use, and easily cleaned.

It is still another object of the present invention to provide a handkerchief that is inexpensive to produce.

It is yet another object of the present invention to provide a handkerchief of relatively simple construction with a minimum of components.

Further objects and advantages of the present invention will be apparent from a study of the following portion of the specification, the claims, and the attached drawings.

DESCRIPTION OF THE PREFERRED EMBODIMENT

Figure 1:
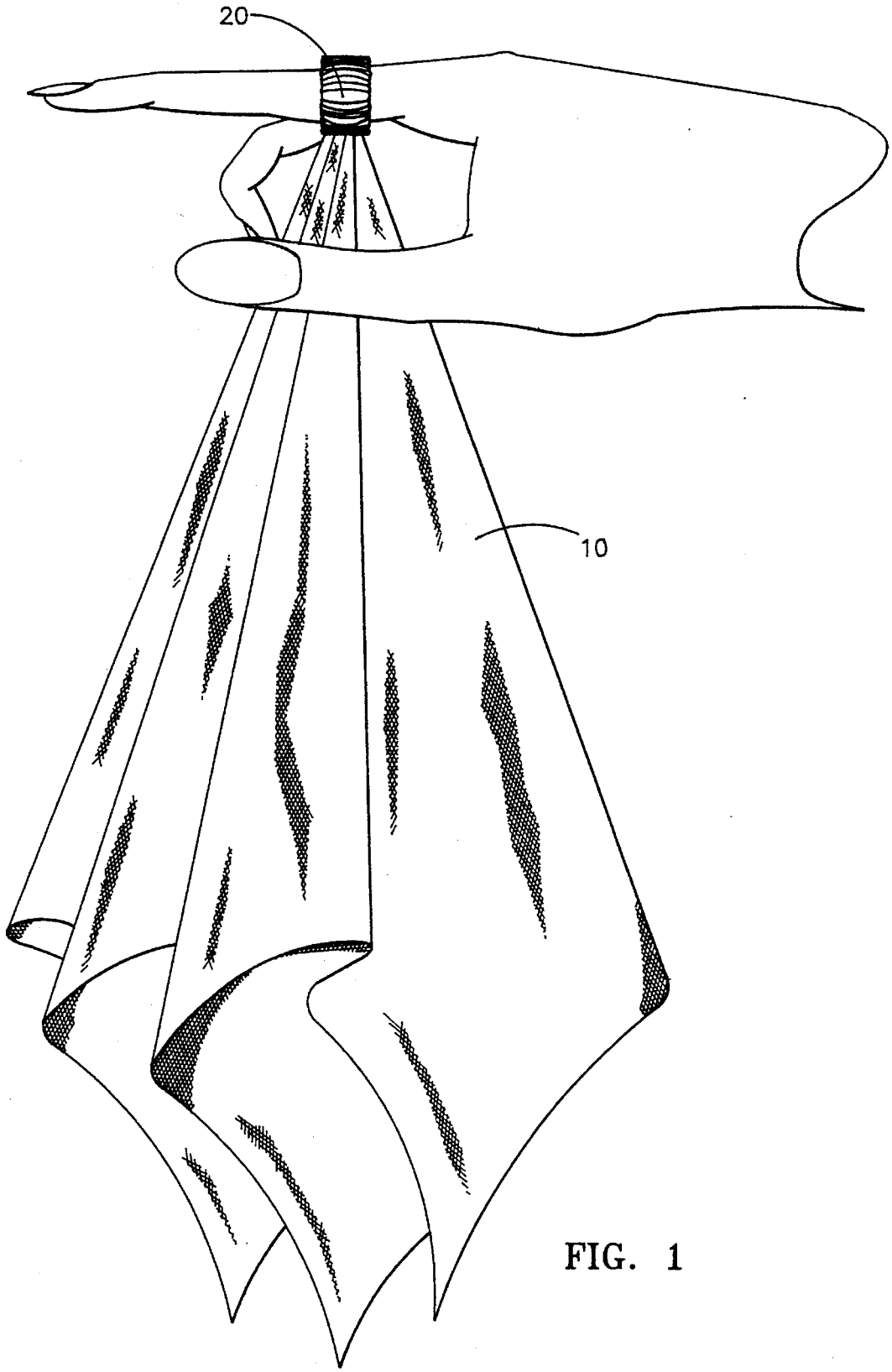
FIG. 1 is a side view illustrating the manner in which the present invention is removably attached to a user's hand.
Figure 2:
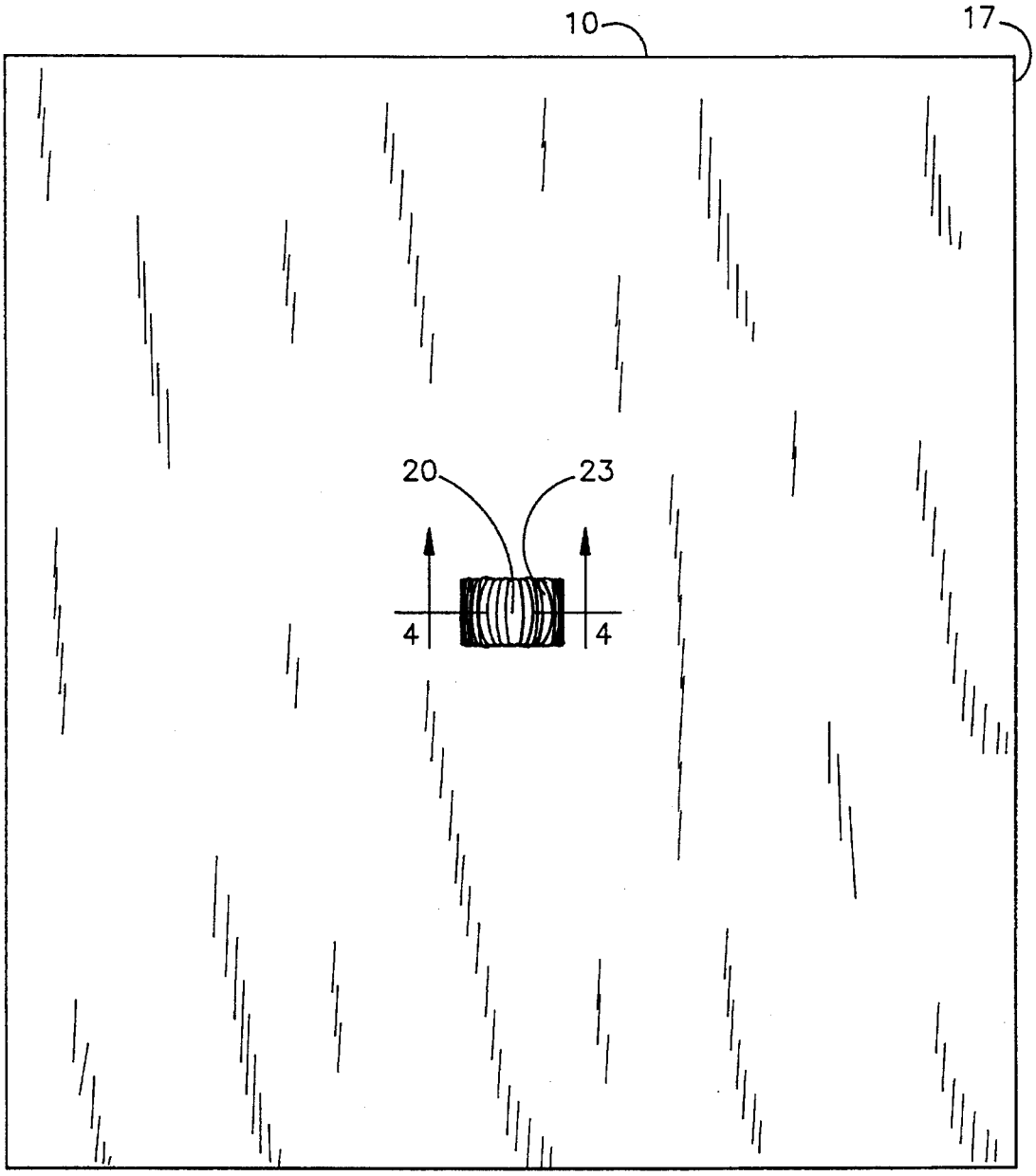
FIG. 2 is a plan view of the present invention.
Figure 3:
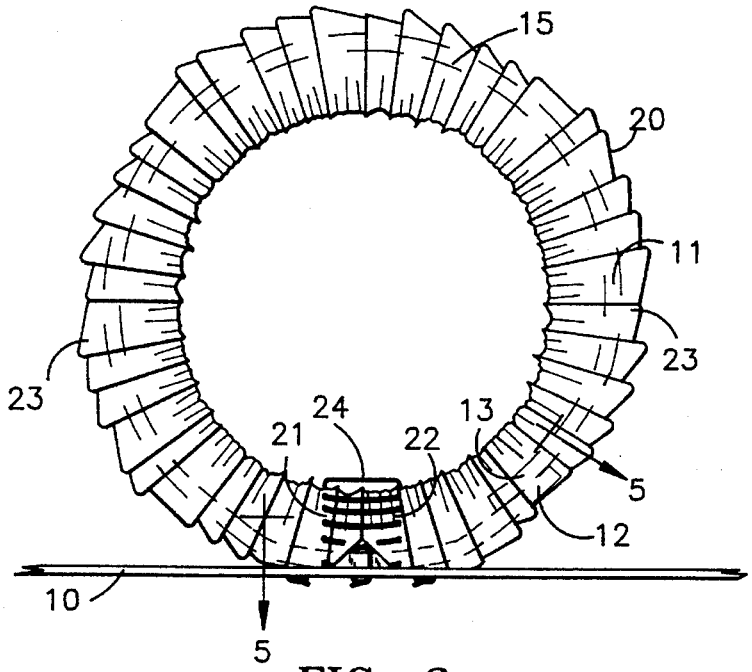
FIG. 3 is a detail side view of the present invention.
Figure 4:
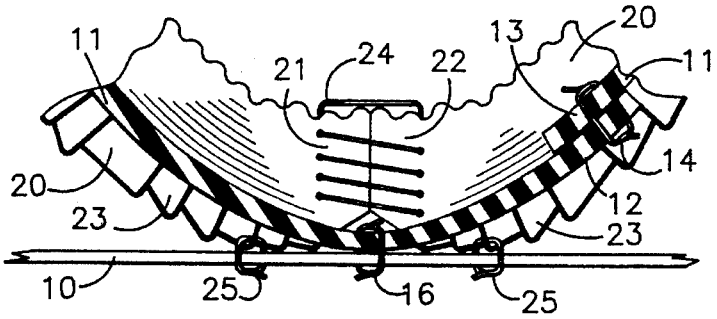
FIG. 4 is a detail section view taken along line 4—4 of FIG. 2.
Figure 5:
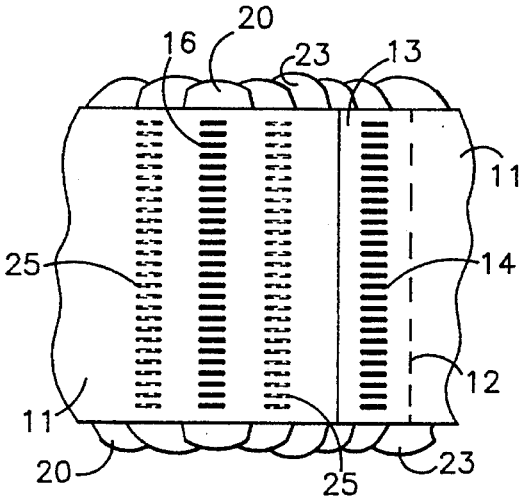
FIG. 5 is a detail section view taken along line 5—5 of FIG. 3.

The following portion of the specification, taken in conjunction with the drawings, sets forth the preferred embodiment of the present invention. The embodiment of the invention disclosed herein is the best mode contemplated by the inventors for carrying out their invention in a commercial environment, although it should be understood that various modifications can be accomplished within the parameters of the present invention.

Referring now to the drawings for a detailed description of the present invention, reference is made to FIGS. 2, 3, 4, and 5, depicting generally square fabric sheet 10 and flexible, elastic strip 11 having strip first end 12 and strip second end 13. Strip first end 12 is attached to strip second end 13, for instance by strip end sewing 14, so that strip 11 forms a closed loop 15. As discussed below, the size of loop 15 is chosen to be slightly smaller than the size of a finger of the user of the present invention, so that a finger may fit within loop 15 with a slight stretching of strip 11. Strip 11 is attached to sheet 10, for instance by strip attachment sewing 16, so that strip 11 is proximate to the center of sheet 10, and the axis of loop 15 formed by strip 11 is disposed parallel to the plane of sheet 10 and to an edge 17 of sheet 10.

Also as depicted in FIGS. 2, 3, 4, and 5, flexible fabric sheath 20, having sheath first end 21 and sheath second end 22, is disposed surrounding strip 11. Sheath 20 may be formed from a rectangle of fabric, where the longer sides of the rectangle have been attached together, for instance by sewing. The length of sheath 20 is chosen to be slightly greater than the length of strip 11, so that corrugations 23 are formed as sheath 20 is disposed surrounding strip 11. Sheath first end 21 is attached, for instance, by sheath end sewing 24 to sheath second end 22, and to sheet 10, for instance, by sheet attachment sewing 25. In a similar manner, sheath second end 22 is attached to sheet 10 by sheet attachment sewing 25.

In use, the present invention is removably disposed about a finger by inserting a finger through loop 15 as shown in FIG. 1. By selecting the size of loop 15 to be slightly smaller than the size of a finger, the present invention is comfortably held in place near the fingers, without requiring the user to continuously grasp the present invention. In this way, the fingers of the user are free to grasp and manipulate other items.

It will be understood that sheet 10 and sheath 20 made be formed from any of a wide variety of natural and man-made fabrics, and that decorations such as lace, beads, and the like may be added to sheet 10 and sheath 20.

The present invention having been described in its preferred embodiment, it is clear that it is susceptible to numerous modifications and embodiments within the ability of those skilled in the art and without the exercise of the inventive faculty.

What is claimed is:

1. A handkerchief which comprises:

a sheet of fabric;

a flexible, elastic closed loop;

a flexible sheath disposed surrounding said loop;

means for attaching said loop to said sheet so that said loop is proximate to the center of said sheet; and means for attaching said sheath to said sheet so that said sheath is proximate to the center of said sheet.

2. An improved handkerchief as defined in claim 1, wherein said sheet is generally rectangular.

3. An improved handkerchief as defined in claim 1, wherein said sheet is generally square.

4. An improved handkerchief as defined in claim 1, wherein the axis of said loop is parallel to the plane of said sheet.

5. An improved handkerchief as defined in claim 1, wherein the axis of said loop is parallel to an edge of said sheet.

6. An improved handkerchief as defined in claim 1, wherein said means for attaching said loop to said sheet comprises sewing said loop to said sheet.

7. An improved handkerchief as defined in claim 1, wherein said means for attaching said sheath to said sheet comprises sewing said sheath to said sheet.

8. A handkerchief which comprises:

a sheet of fabric;

a flexible, elastic strip having a strip first end and a strip second end;

means for attaching said strip first end to said strip second end so that said strip forms a closed loop;

means for attaching said strip to said sheet so that said strip is proximate to the center of said sheet;

a flexible sheath having a sheath first end and a sheath second end, said sheath disposed surrounding said strip; and means for attaching said sheath first end to said sheath second end, and said sheath first end and said said sheath second end to said sheet.

9. An improved handkerchief as defined in claim 8, wherein said sheet is generally rectangular.

10. An improved handkerchief as defined in claim 8, wherein said sheet is generally square.

11. An improved handkerchief as defined in claim 8, wherein the axis of the loop formed by said strip is parallel to the plane of said sheet.

12. An improved handkerchief as defined in claim 8, wherein the axis of the loop formed by said strip is parallel to an edge of said sheet.

13. An improved handkerchief as defined in claim 8, wherein said means for attaching said strip first end to said strip second end comprises sewing said strip first end to said strip second end.

14. An improved handkerchief as defined in claim 8, wherein said means for attaching said said strip to said sheet comprises sewing said strip to said sheet.

15. An improved handkerchief as defined in claim 8, wherein said means for attaching said sheath first end to said sheath second end, and said sheath first end and said said sheath second end to said sheet comprises sewing said sheath first end to said sheath second end, and sewing said sheath first end and said sheath second end to said sheet.

16. A handkerchief which comprises:

a generally square sheet of fabric;

a flexible, elastic strip having a strip first end and a strip second end;

means for attaching said strip first end to said strip second end so that said strip forms a closed loop;

means for attaching said strip to said sheet so that said strip is proximate to the center of said sheet and the axis of the loop formed by said strip is disposed parallel to the plane of said sheet and to an edge of said sheet;

a flexible sheath having a sheath first end and a sheath second end, said sheath disposed surrounding said strip; and means for attaching said sheath first end to said sheath second end, and said sheath first end and said said sheath second end to said sheet.

17. An improved handkerchief as defined in claim 16, wherein said means for attaching said strip first end to said strip second end comprises sewing said strip first end to said strip second end.

18. An improved handkerchief as defined in claim 16, wherein said means for attaching said said strip to said sheet comprises sewing said strip to said sheet.

19. An improved handkerchief as defined in claim 16 wherein said means for attaching said sheath first end to said sheath second end, and said sheath first end and said said sheath second end to said sheet comprises sewing said sheath first end to said sheath second end, and sewing said sheath first end and said sheath second end to said sheet.

* * * * *